US009499895B2

(12) United States Patent
Langan et al.

(10) Patent No.: US 9,499,895 B2
(45) **Date of Patent: *Nov. 22, 2016**

(54) REACTIVE MATERIALS AND THERMAL SPRAY METHODS OF MAKING SAME

(75) Inventors: Timothy Langan, Catonsville, MD (US); W. Mark Buchta, Ellicott City, MD (US); Michael A. Riley, Towson, MD (US)

(73) Assignee: Surface Treatment Technologies, Inc., Halethorpe, MD (US)

( * ) Notice: Subject to any disclaimer, the term of this patent is extended or adjusted under 35 U.S.C. 154(b) by 1447 days.

This patent is subject to a terminal disclaimer.

(21) Appl. No.: 10/873,411

(22) Filed: Jun. 21, 2004

(65) Prior Publication Data

US 2005/0100756 A1 May 12, 2005

Related U.S. Application Data

(63) Continuation-in-part of application No. 10/869,094, filed on Jun. 16, 2004.

(60) Provisional application No. 60/478,761, filed on Jun. 16, 2003.

(51) Int. Cl.

| | |
|---|---|
| ***B05D 1/00*** | (2006.01) |
| ***B05D 1/08*** | (2006.01) |
| ***B05D 1/12*** | (2006.01) |
| ***C23C 4/12*** | (2016.01) |
| ***C23C 4/04*** | (2006.01) |
| ***F42B 1/032*** | (2006.01) |
| ***C23C 24/04*** | (2006.01) |
| ***C23C 28/04*** | (2006.01) |
| ***C23C 28/00*** | (2006.01) |

(52) U.S. Cl.
CPC . *C23C 4/12* (2013.01); *C23C 4/04* (2013.01); *C23C 24/04* (2013.01); *C23C 28/042* (2013.01); *C23C 28/42* (2013.01); *F42B 1/032* (2013.01); *Y10T 428/12507* (2015.01); *Y10T 428/12562* (2015.01); *Y10T 428/12569* (2015.01)

(58) Field of Classification Search
USPC ..... 427/446–456
See application file for complete search history.

(56) References Cited

U.S. PATENT DOCUMENTS

| | | | |
|---|---|---|---|
| 3,135,205 | A | 6/1964 | Zwicky |
| 3,235,005 | A | 2/1966 | Delacour |
| 3,726,643 | A | 4/1973 | Merzhanov et al. |
| 3,961,576 | A | 6/1976 | Montgomery, Jr. |
| 4,161,512 | A | 7/1979 | Merzhanov et al. |
| 4,431,448 | A | 2/1984 | Merzhanov et al. |
| 4,498,367 | A | 2/1985 | Skolnick et al. |
| 4,557,771 | A | 12/1985 | Bencz et al. |
| 4,593,007 | A | 6/1986 | Novinski |

(Continued)

FOREIGN PATENT DOCUMENTS

| | | |
|---|---|---|
| DE | 32 18 205 A1 | 10/1985 |
| EP | 0 694 754 A2 | 1/1996 |

*Primary Examiner* — Erin Saad
(74) *Attorney, Agent, or Firm* — Alan G. Towner, Esq.; Pietragallo Gordon Alfano Bosick & Raspanti, LLP

(57) ABSTRACT

The present invention relates to reactive materials formed by thermal spray techniques. The thermally sprayed reactive materials have low porosity and high structural integrity. The reactive materials are useful for applications such as shaped charges, thermite welding, near net shaped components and the like.

32 Claims, 3 Drawing Sheets

(56) References Cited

U.S. PATENT DOCUMENTS 4,710,348 A 12/1987 Brupbacher et al.
4,766,813 A 8/1988 Winter et al.
4,783,379 A * 11/1988 Wickersham et al. ..... 428/607
4,836,982 A 6/1989 Brupbacher et al.
4,839,239 A * 6/1989 Ducos et al. ..... 428/623
4,915,905 A 4/1990 Kampe et al.
4,917,964 A 4/1990 Moshier et al.
4,958,569 A 9/1990 Mandigo
5,015,534 A 5/1991 Kampe et al.
5,090,324 A 2/1992 Bocker et al.
5,098,487 A 3/1992 Brauer et al.
5,119,729 A 6/1992 Nguyen
5,175,391 A 12/1992 Walters et al.
5,198,188 A * 3/1993 Holt et al. ..... 419/45
5,266,132 A 11/1993 Danen et al.
5,331,895 A 7/1994 Bourne et al.
5,413,048 A 5/1995 Werner et al.
5,466,537 A 11/1995 Diede et al.
5,467,714 A 11/1995 Lund et al.
5,490,911 A 2/1996 Makowiecki et al.
5,505,799 A 4/1996 Makowiecki
5,523,048 A 6/1996 Stinson et al.
5,538,795 A 7/1996 Barbee, Jr. et al.
5,547,715 A 8/1996 Barbee, Jr. et al.
5,606,146 A 2/1997 Danen et al.
5,656,791 A 8/1997 Reese et al.
5,773,748 A 6/1998 Makowiecki et al.
5,852,256 A 12/1998 Hornig
5,859,383 A 1/1999 Davison et al.
5,939,664 A 8/1999 Kapoor
6,012,392 A 1/2000 Norman et al.
6,021,714 A 2/2000 Grove et al.
6,123,999 A * 9/2000 Felix et al. ..... 427/449
6,143,241 A * 11/2000 Hajaligol et al. ..... 419/31
6,152,040 A 11/2000 Riley et al.
6,446,558 B1 9/2002 Peker et al.
6,455,167 B1 * 9/2002 Rigney et al. ..... 428/472.2
6,530,326 B1 3/2003 Wendt, Jr. et al.
6,534,194 B2 3/2003 Weihs et al.
6,564,718 B2 5/2003 Reese et al.
6,588,344 B2 7/2003 Clark et al.
6,596,101 B2 7/2003 Weihs et al.
6,634,300 B2 10/2003 Reese et al.
6,655,291 B2 12/2003 Pratt et al.
6,736,942 B2 5/2004 Weihs et al.
6,863,992 B2 3/2005 Weihs et al.
6,881,284 B2 4/2005 Makowiecki et al.
6,962,634 B2 11/2005 Nielson et al.
6,991,855 B2 1/2006 Weihs et al.
6,991,856 B2 1/2006 Weihs et al.
7,278,353 B2 10/2007 Langan et al.
7,278,354 B1 10/2007 Langan et al.
7,361,412 B2 4/2008 Wang et al.
2001/0025783 A1 * 10/2001 Sundarrajan et al. ... 204/192.12
2001/0046597 A1 11/2001 Weihs et al.
2002/0027817 A1 * 3/2002 Kida et al. ..... 365/200
2002/0081243 A1 * 6/2002 He ..... 422/177
2002/0182436 A1 12/2002 Weihs et al.
2003/0012678 A1 1/2003 Sherman
2003/0138659 A1 * 7/2003 Shanker ..... 428/632
2003/0164289 A1 9/2003 Weihs et al.
2004/0060625 A1 4/2004 Barbee, Jr. et al.
2005/0051607 A1 3/2005 Wang et al.
2005/0082343 A1 4/2005 Wang et al.
2005/0136270 A1 6/2005 Besnoin et al.
2006/0068179 A1 3/2006 Weihs et al.
2007/0042112 A1 * 2/2007 Vassen et al. ..... 427/115
2008/0173206 A1 7/2008 Langan et al.

* cited by examiner

REACTIVE MATERIALS AND THERMAL SPRAY METHODS OF MAKING SAME

CROSS-REFERENCE TO RELATED APPLICATIONS

This application is a continuation-in-part of U.S. application Ser. No. 10/869,094 filed Jun. 16, 2004, by Timothy Langan, W. Mark Buchta and Michael A. Riley entitled "Reactive Materials and Thermal Spray Methods of Making Same", which claims the benefit of U.S. Provisional Patent Application Ser. No. 60/478,761 filed Jun. 16, 2003, both of which are incorporated herein by reference.

GOVERNMENT CONTRACT

The United States Government has certain rights to this invention pursuant to Contract No. DASG60-03-C-0025 awarded by the U.S. Army Space and Missile Defense Command and Contract No. F08630-03-C-0022 awarded by the U.S. Air Force.

FIELD OF THE INVENTION

The present invention relates to reactive materials, and more particularly relates to thermal spray production of reactive materials that are useful for applications such as structural materials, shaped charges, thermite welding, near net shaped components and the like.

BACKGROUND INFORMATION

Reactive materials have conventionally been used for applications such as thermite welding and near net shaped components. Conventional thermite welding involves the blending of specific oxides and metal powders to form a chemically balanced formula that, when heated locally to a certain reaction temperature, produces a self-sustaining high temperature reaction capable of melting ferrous alloys and welding them together.

Self-sustained high temperature synthesis (SHS) and exothermic dispersion (XD) processes involve the use of reactive materials. Examples of SHS processes are disclosed in U.S. Pat. Nos. 3,726,643, 4,161,512 and 4,431,448. Examples of XD processes are disclosed in U.S. Pat. Nos. 4,710,348, 4,836,982, 4,915,905, 4,917,964 and 5,015,534.

Shaped charges comprising a metal liner and an explosive backing material are used for various applications such as mining, metal cutting, warheads and oil well bores. For example, the use of shaped charges in rock quarries is disclosed in U.S. Pat. No. 3,235,005 to Delacour. The use of shaped charges for perforating operations in oil and gas wells is disclosed in U.S. Pat. Nos. 4,498,367, 4,557,771, 4,958,569, 5,098,487, 5,413,048, 5,656,791, 5,859,383, 6,012,392, 6,021,714, 6,530,326, 6,564,718, 6,588,344, 6,634,300 and 6,655, 291. Other shaped charges are disclosed in U.S. Pat. Nos. 3,135,205 4,766,813, 5,090,324, 5,119,729, 5,175,391, 5,939,664, 6,152,040 and 6,446,558.

The present invention has been developed in view of the foregoing.

SUMMARY OF THE INVENTION

The present invention provides a method of producing reactive materials utilizing a thermal spray process. Reactive components are thermally sprayed together and/or sequentially to build up a "green body" comprising the reactive components. Coatings or structures can be made using a variety of thermal deposition methods including: plasma arc spray deposit, electric wire arc, combustion powder, combustion wire, high velocity oxy-fuel (HVOF) or a combination of these techniques. In addition, application can be performed using ambient, low-pressure or inert atmospheres. Material combinations may be applied as a composite blend, simultaneous co-spray of two or more materials or as discrete layers by spraying each material separately. The resultant reactive material has high density with commensurate mechanical strengths that are suitable for structural applications. Although a portion of the reactive components may react with each other during the thermal spraying operation, at least a portion (e.g., 1-99 weight percent) of the components remain unreacted in the green body. The reactive material may subsequently be reacted by any suitable initiation technique, such as a localized heat source or bulk heating of the material, e.g., by high strain rate deformation (explosive shock heating). The invention may also provide reaction rate control mechanisms within the thermally sprayed structure through the use of non-reactive intermediate layers that can be placed between the reactive layers. These layers can also be placed on the outside of the thermally sprayed body to protect the body from premature reactions caused by excessive force or high temperature.

An aspect of the present invention is to provide a method of thermal spraying reactive materials. The method includes simultaneous or sequential thermal spraying of multiple reactive components to build up a green body of the reactive material.

Another aspect of the present invention is to provide a reactive material including thermally sprayed reactive components.

A further aspect of the present invention is to provide a method of initiating reaction of a thermally sprayed reactive material by high strain rate deformation.

These and other aspects of the present invention will be more apparent from the following description.

DETAILED DESCRIPTION

Figure 1:
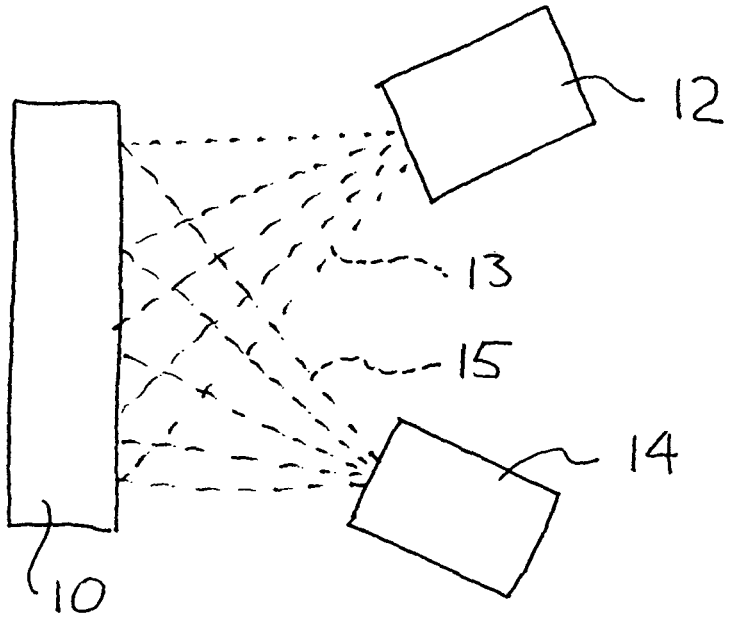
FIG. 1 is a partially schematic illustration of a thermal spray process utilizing two separate sources of reactive components in accordance with an embodiment of the present invention.

The present invention utilizes a thermal spray process to produce reactive materials. As used herein, the term "thermal spray" includes processes such as flame spraying, plasma arc spraying, electric arc spraying, combustion powder, combustion wire, high velocity oxy-fuel (HVOF) deposition, cold spraying, detonation gun deposition and super detonation gun deposition, as well as others known to those skilled in the art. Source materials for the thermal spray process include powders, wires and rods of material that are fed into a flame where they are partially or fully melted. When wires or rods are used as the feed materials, molten stock is stripped from the end of the wire or rod and atomized by a high velocity stream of compressed air or other gas that propels the material onto a substrate or workpiece. When powders are used as the feed materials, they may be metered by a powder feeder or hopper into a compressed air or gas stream that suspends and delivers the material to the flame where it is heated to a molten or semi-molten state and propelled to the substrate or workpiece. A bond may be produced upon impact of the thermally sprayed reactive components on the substrate. As the molten or semi-molten plastic-like particles impinge on the substrate, several bonding mechanisms are possible. Mechanical bonding may occur when the particles splatter on the substrate. The particles may thus mechanically interlock with other deposited particles. In addition, localized diffusion or limited alloying may occur between the adjacent thermally sprayed materials. In addition, some bonding may occur by means of Van der Waals forces. In the current case of forming a body of reactive materials, the high temperature impact may also result in chemical bonding of the powders.

The present thermally sprayed reactive materials comprise at least two reactive components. As used herein, the term "reactive components" means materials that exothermically react to produce a sufficiently high heat of reaction. Elevated temperatures of at least 1,000° C. are typically achieved, for example, at least 2,000° C. In one embodiment, the reactive components may comprise elements that exothermically react to form intermetallics or ceramics. In this case, the first reactive component may comprise, for example, Ti, Ni, Ta, Nb, Hf, W, V, U and/or Si, while the second reactive component may comprise Al, Mg, Ni, C and/or B. Typical materials formed by the reaction of such reactive components include $TiAl_x$ (e.g., TiAl, $TiAl_3$, $Ti_3Al$), NiAl, $TaAl_3$, $NbAl_x$, SiAl, TiC, $TiB_2$, VC, WC and VAl. Thermite powders may also be suitable. In this case, one of the reactive components may comprise at least one metal oxide selected from $Fe_xO_y$, $Ni_xO_y$, $Ta_xO_y$, $TiO_2$, $CuO_x$, $WO_x$ and $Al_2O_3$, and another one of the reactive components may comprise at least one material selected from Al, Mg, Ni and $B_4C$. More than two reactive components may be used, e.g., Al/Ni/NiO, Ni/Al/Ta, etc.

By proper alloy selection, it is possible to form alloy layers or particles that will chemically equal an unreacted intermetallic compound. By forming these structures by thermal spray techniques, the unreacted body is a substantially fully dense solid structure complete with mechanical properties that permit its use as a load bearing material. Under proper ignition conditions (explosive or other), the materials undergo an exothermic intermetallic reaction. In one embodiment, the reactivity of the reactive components is controlled such that slow heating below certain temperatures does not initiate the exothermic reaction, thereby avoiding unwanted ignition.

The present reactive bodies differ from compressed powder reactions because there is substantially no impurity outgassing. In addition, pressed powerder compositions used in conventional shaped charges tend to rapidly disperse into powders after shock initiation. They also differ from reactive metals like zirconium because the entire body reaches its peak exotherm, not just the exposed edges. This permits the fragmented sections of the body to maintain thermal output levels much longer than either powder reactants or pyrophoric metals. Given the ability to control self-propagating reactions via the forming process, a great degree of tailorability may be achieved with the present reactive materials.

FIG. 1 illustrates a thermal spray process in accordance with an embodiment of the present invention. A substrate 10 is placed in front of a first thermal spray gun 12 and a second thermal spray gun 14. The first thermal spray gun 12 may be used to thermally spray one reactive component 13 of the reactive material. The second thermal spray gun 14 may be used to spray another reactive component 15 of the reactive material. The thermally sprayed materials 13 and 15 build up on the surface of the substrate 10. More than two thermal spray guns may be used in this process.

Figure 3:
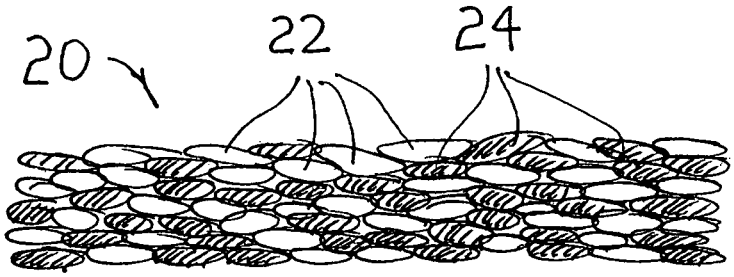
FIG. 3 schematically illustrates a thermally sprayed reactive material comprising a mixture of deposited particulates of different reactive components in accordance with an embodiment of the present invention.

In the embodiment shown in FIG. 1, both thermal spray guns 12 and 14 may be used simultaneously to produce a reactive material comprising intermixed particles of the first and second reactive components. Such a thermally sprayed particulate mixture is shown in FIG. 3, as more fully described below. Alternatively, the first and second thermal spray guns 12 and 14 may be operated sequentially in order to build up alternating layers of the first and second reactive materials. An example of the deposition of alternating layers of the first and second reactive components in shown in FIG. 4. As another alternative, one or both of the thermal spray guns 12 and 14 shown in FIG. 1 may deliver a mixture of both of the reactive component materials to the substrate 10.

Figure 2:
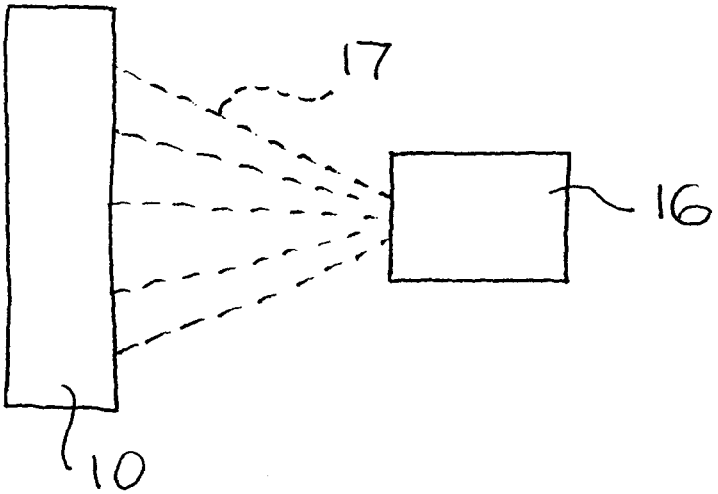
FIG. 2 is a partially schematic illustration of a thermal spray process utilizing a single source comprising a mixture of reactive components in accordance with another embodiment of the present invention.

FIG. 2 illustrates a thermal spray process in accordance with another embodiment of the present invention. In this embodiment, a single thermal spray gun 12 is used to deliver a mixture of reactive materials 17 to the surface of the substrate 10. For example, a powder mixture comprising particulates of both reactive components of the reactive material may be fed through the thermal spray gun 16. Alternatively, wires or rods of the different reactive component materials may be simultaneously fed through the thermal spray gun 16. As another alternative, powders of the reactive components may be sequentially fed through the thermal spray gun 16 in an alternating manner. Also, wires or rods of the different reactive component materials may alternately be fed through the thermal spray gun 16.

FIG. 3 schematically illustrates a thermally sprayed reactive material 20 comprising a mixture of deposited particles of a first reactive component 22 and a second reactive component 24.

Figure 4:
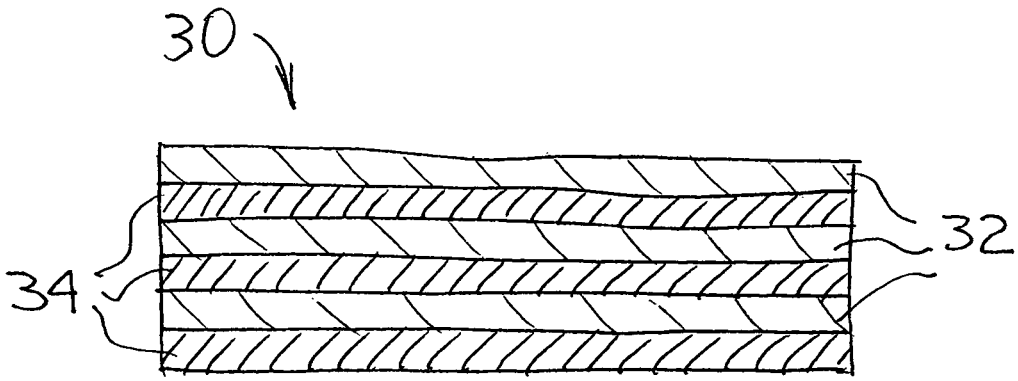
FIG. 4 schematically illustrates a reactive material comprising alternating thermally sprayed layers of reactive components in accordance with another embodiment of the present invention.

FIG. 4 schematically illustrates a thermally sprayed reactive material 30 comprising alternating layers of a first thermally sprayed reactive component material 32 and a second thermally sprayed reactive component material 34. Each layer 32 and 34 may have any desired thickness, e.g., from about 1 micron to about 5 mm.

Figure 5:
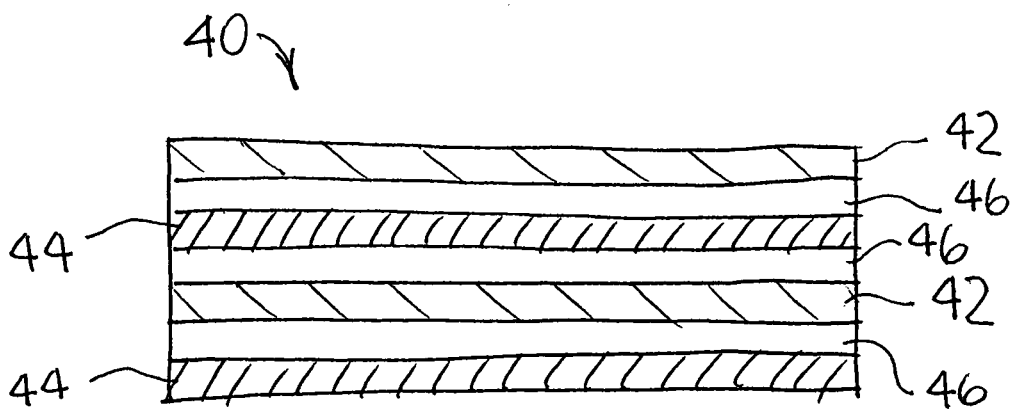
FIG. 5 schematically illustrates a reactive material comprising thermally sprayed layers of reactive components separated by layers of inert material in accordance with a further embodiment of the present invention.

FIG. 5 illustrates a reactive material 40 comprising thermally sprayed layers of first and second reactive components 42 and 44, separated by layers of inert material 46 such as $Al_2O_3$ or SiO. The inert material layers 46 may be thermally sprayed, or may be deposited by any other suitable technique.

Figure 6:
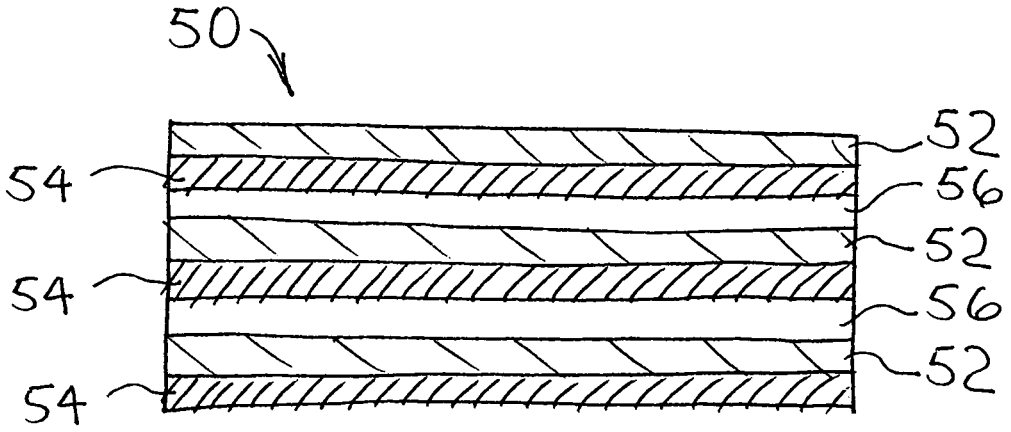
FIG. 6 schematically illustrates a reactive material comprising pairs of thermally sprayed reactive component layers separated by layers of inert material in accordance with another embodiment of the present invention.

FIG. 6 illustrates a reactive material 50 comprising pairs of thermally sprayed reactive component layers 52 and 54, separated by layers of inert material 56.

The thermally sprayed reactive components are deposited on the substrate at a rate of at least 0.01 mm per hour. For example, the thermally sprayed reactive components are deposited on the substrate at a rate of at least 0.1 mm per hour, preferably at a rate of at least 1 mm per hour.

The thermally sprayed reactive materials of the present invention typically have a density of at least 90 percent of the theoretical density of the material, i.e., a porosity of less than 10 volume percent. Preferably, the density of the thermally sprayed reactive material is at least 94 or 95 percent, more preferably at least 97 or 98 percent. Porosities of less than 5 volume percent and even less than 2 volume percent may be achieved. To achieve full density of the body, the process can also thermally deposit reactive polymer matrices such as fluoropolymers to fill in the voids. Upon shock initiation, these polymers may be consumed and act as an oxidizer to increase the thermal energy generated from the reaction.

The present thermally sprayed reactive materials may possess favorable mechanical properties, making them suitable for use in various structural applications. For example, the reactive material may have a tensile yield strength of at least 5 ksi. In some preferred embodiments, the reactive material has a tensile yield strength of at least 10 or 15 ksi, or higher.

The thermally sprayed reactive materials may optionally include protective coatings, such as coatings which reduce or eliminate unwanted reactions. For example, the reactive material may be at least partially coated with known fire retardant materials such as ceramic layers. Alternatively, the reactive material may be at least partially coated with at least one layer of a substantially non-reactive, mechanically shock resistant rubber or polymer.

The following examples are intended to illustrate various aspects of the present invention, and are not intended to limit the scope of the invention.

Example 1

Vacuum Plasma Spray, Cylindrical Coatings or Structures

Ni and Al powders were applied to cylindrical substrates using a conventional plasma arc system installed in a vacuum chamber. Sample CS-1 was made by spraying a Ni (−325 mesh) and Al (−200, +325 mesh) composite blend of approximately 1:1 atomic ratio. With this ratio, it was believed that reaction of the material would result in complete conversion to nickel aluminide (Ni+Al→NiAl). The substrate was a solid copper (Cu) rod, 2.25-inches in diameter×4-inches in length polished with 1000 grit abrasive paper. The rod was mounted in a chuck that was attached to the end of a rotating shaft that also translated horizontally to move the substrate through the spray pattern of the plasma gun. The gun was mounted to a robotic arm that translated in both axes normal to the rotational axis. Air jets were arranged to blow on the sample during coating in order to provide cooling and prevent a premature Ni+Al reaction. Substrate and coating temperature were monitored throughout the process with an optical pyrometer.

After evacuating the chamber and backfilling to a partial pressure of argon, the coating was applied to the rotating/translating substrate. The powder blend was fed from one hopper through a single injector. The coating layer was built to a thickness of approximately 0.143-inch. The coating surface was fairly smooth and regular with no obvious porosity or defects.

The coated substrate was lathe-machined to remove the substrate core and to finish the internal and external diameters of the deposited material. The resulting tube was approximately 2.25-inches length with an internal diameter (I.D.) of 2.25-inches and 0.120-inch wall thickness. The surface exhibited normal tooling marks and, except for some damage caused by removal of the substrate, no defects were noted.

The reactivity characteristics of the composition were tested by heating a small portion of the sample with the flame from a propane torch. The flame was concentrated at one end of the sample. After a short period of heating, shiny, metallic areas appeared within the material and, shortly thereafter, a white-hot, exothermic reaction occurred and rapidly propagated along the length of the sample.

Example 2

Another vacuum plasma spray (VPS) coating, CS-2, was made in a manner similar to CS-1 of Example 1. However, CS-2 was fabricated using two material feed hoppers and injectors. One hopper supplied the Ni powder to an injector while the second hopper fed the Al powder to another injector. Although both powders were injected into the plasma arc simultaneously, the density differences resulted in disparate particle velocities. This phenomenon, in conjunction with the planar and rotational motion of the substrate created a spiral-like deposition of the powders. The coating was applied to a thickness of 0.252-0.305-inch. The substrate was machined to remove it and the tube finished to a wall thickness of 0.220-0.225-inch.

When a portion of CS-2 was subjected to the propane torch ignition test, it took longer for the reaction to start compared to CS-1 and the propagation rate was only about 25% of the previous sample.

It is believed that the differences in reaction propensity and rate can be attributed to the method of application. When spraying a composite blend, it is presumed to be easier to obtain the proper particle distribution and stoichiometry. When using the two-feeder method, several variables for each material, such as powder feed rate, hopper pressurization, point of insertion into the arc, deposition efficiency, etc. are interrelated and must be optimized so as to obtain the desired distribution.

Differential scanning calorimetry (DSC) analysis was performed on CS-1 and CS-2. The results show that the total exothermic energy density for CS-1 (composite blend) is more than 50% greater than CS-2 (co-spray, layered). The DSC curve for CS-1 shows that the exotherm corresponding to Ni+Al diffusion in the solid state starts at approximately 275° C. The rate of energy release changes several times, presumably as the various aluminides are formed (e.g., $NiAl_3$, $Ni_2Al_3$, NiAl, $Ni_3Al$, etc.). There is an endotherm at about 624° C. corresponding to melting of aluminum or an aluminum-rich compound immediately followed by a fast, strong exothermic reaction believed to be liquid-phase aluminide formation. For CS-2, aluminide formation via diffusion starts at approximately 320° C. and proceeds much like CS-1. However, these reactions in the solid state comprise a larger fraction of the total energy output compared to CS-1. Thus, the sharp energy impulse resulting from rapid intermetallic formation in the liquid phase has been attenuated for CS-2. This accounts for the delayed, slower reaction that resulted when CS-2 underwent ignition testing.

Example 3

Other VPS Ni+Al coatings were produced using Cu tubing (2-inch I.D., 0.062-inch wall) as the substrate rather than solid bar. Sample VPS-333 was coated to a thickness of approximately 0.334-inch using a composite powder blend. Sample VPS-335 was a two-feeder, layered coating approximately 0.389-inch thick. Portions of each sample underwent ignition/reactivity testing. Both ignited and propagated slowly, with VPS-335 appearing to be a little hotter than VPS-333.

Chemical analyses of VPS-333 and VPS-335 shows that the as-sprayed compositions are both slightly Ni-rich. A 1:1 Ni/Al atomic ratio is approximately 68 Ni-32 Al (wt %). VPS-333 (composite blend) was close at about 70 Ni-30 Al. VPS-335 (co-sprayed, layered) analyzed at about 76 Ni-22 Al, confirming that stoichiometry is harder to maintain with the co-spray method though VPS-335 seemed to get hotter during reaction. It was thought that perhaps some oxides in VPS-335 were initiating thermite type reactions in addition to the NiAl formation. However, X-ray diffraction analysis of VPS-335 revealed only Ni and Al, no metallic oxides.

DSC analysis of VPS-333 and VPS-335 showed that 335 (co-sprayed, layered) had almost three times the energy density of 333 (composite blend). This is contradictory to the data from CS-1 and CS-2 but, in all cases, the majority of the exotherm occurs during slow diffusion over an extended temperature range. It is only after the aluminum melts (approximately 625° C.) that an exothermic spike, indicative of fast energy release is seen. However, this fast, liquid-phase reaction accounts for less than 20% of the total energy output for both VPS-333 and VPS-335. This data correlates with the slow reaction rates seen during ignition testing of these samples and the fact that VPS-335 appeared hotter overall.

Example 4

Air Plasma Spray, Cylindrical Coatings or Structures

In addition to the VPS samples, some air plasma spray (APS) coatings were also produced. These samples were made in the same manner as the VPS samples except that the vacuum and argon backfill steps were omitted. Sample APS-329 comprised a 2-inch I.D., 0.063-inch wall Cu tube sprayed with the Ni/Al composite blend. Coating thickness was built to about 0.305-inch. Sample APS-337 was sprayed using the two-feeder, layered technique and a coating thickness of approximately 0.280-inch was obtained. Both coatings appeared dense and defect free.

Reactivity tests were performed on both samples with similar results. Each sample ignited and the reaction propagated rapidly with white heat. Propagation rate was much faster than the VPS samples (except for CS-1).

Chemical analysis of the APS samples showed that the composite blend coating (APS-329) contained approximately 67 Ni-33 Al, conforming closely to the target, 1:1 atomic ratio. The co-sprayed sample (APS-337) was Ni-rich (similar to its VPS counterpart) at approximately 70 Ni-27Al. However, the reaction characteristics of both samples were comparable.

DSC analysis indicated that the overall energy densities of both samples were also similar. It appears that solid-state diffusion for APS-329 comprised a larger portion of the total exotherm compared to APS-337.

Example 5

Additional APS samples were made with a plasma system comprising a spray gun with two feeders so that co-sprayed, alternate layer and composite coatings could be applied. Sample 1-1 was an aluminum tube, 2.5-inches outside diameter×18-inches length. This tube was inserted into a rotating headstock and air blast cooling was used on and through the tube during coating. The plasma gun was attached to a manipulator that provided vertical and horizontal translation. For sample 1-1 the standoff distance was set at 5-inches and the spray pattern was centered on the rotating (approximately 420 rpm) sample. Traverse direction was parallel to the rotational axis and the speed was 1-inch/second. Each spray cycle comprised traversing to the end of the sample and back. One powder feeder was filled with Metco 54-NS aluminum (−200, +325 mesh) and the other contained Metco 56F-NS nickel (−325 mesh, +11 μm). Powder feed rates were set at about 18 lbs/h for the nickel and 9-10 lbs/h for the aluminum. After spraying 6 cycles, coating thickness was approximately 0.045-inch. The coating was smooth and defect-free, however, the color appeared light, leading to speculation that the coating was aluminum-rich. A section of sample 1-1 was machined to remove the substrate and finish the outside surface. A sample was taken from an attached witness plate and subjected to ignition testing. The material did not react. Subsequently, several experiments were conducted with rectangular, steel plate substrates to determine the correct ratio of Ni to Al. Each sample coating was built to a thickness of approximately 0.100-inch. The nickel spray rate was held at 18 lbs/h and the aluminum rate was varied between 3-7 lbs/h. At these ratios there was either no reaction or one that was non-sustained. The spray rate for nickel was then increased to 22 lbs/h while holding the aluminum at 4 lbs/h. The coating from this sample reacted and propagated slowly, stopping before completion. The sample was being held by pliers and, when the pliers were removed, the reaction continued to the end of the piece. The sample section was relatively thin and it is believed that the pliers may have been acting as a heat sink.

Examples 6

Some Ni/Al composite coatings were sprayed on rectangular samples. The nickel powder size and ratio were changed to determine the effects on reactivity. Sample 1-6 utilized 68% Metco 56C-NS nickel (−200, +325 mesh). Powder feed rate was about 10 lbs/h. The sample with this coarser nickel powder exhibited inconsistent reactivity results. Some sections ignited and propagated rapidly to completion, others ignited and propagated partially before quenching. The nickel content for sample 1-8 was changed to 72%. This material ignited and achieved high temperature but did not propagate totally. For sample 1-9, the nickel content was changed to 75% and the finer material (56F) was used. This coating ignited and reacted readily, but quenched before completion. It is believed that the thin sections used for reactivity testing were not generating sufficient heat to allow propagation to the end point.

A thicker coating was applied for sample 1-11. The composite mix contained 70% 56F-NS nickel, sprayed at about 12 lbs/h. The coating was built to approximately 0.220-inch. Ignition testing produced a hot reaction that proceeded at moderate speed to completion. Since this composition seemed to produce the best results, it was used to continue spraying on sample 1-1, the previously coated tube sample. Both powder feeders were utilized, each spraying the composite mixture at approximately 12 lbs/h. The coating was applied in 10-cycle increments, stopping for measurements and cooling after each increment. Occasional problems were encountered with clogging of the powder ports. Because the ports are so close to the plasma flame, they are subject to blowback of the injected powder. When this occurs, the powder feed rate decreases and the ports must be cleaned or replaced. Twelve of the 10-cycle increments were used to build the coating thickness to about 0.530-inch. The coating was smooth and crack free. Periodic reaction testing of witness samples confirmed that the material composition remained consistent.

In order to determine the effect of Ni particle size, a thicker coating containing the coarse Ni powder was applied to sample 1-13, a rectangular plate. A composite containing 70% 56C-NS nickel was blended and sprayed to a thickness of 0.160-0.170-inch. When this coating underwent ignition testing, it took several attempts to start the reaction. When the reaction did start, it propagated very slowly and the velocity seemed to increase slightly as it progressed. It is not known why the coarser nickel produces slower, less energetic reactions than the finer. One possibility is that the increased surface area of the fine Ni results in greater oxidation and, thus, more thermite-type reaction.

Sample 1-14 was an attempt to produce a round sample by spraying on a disc-shaped substrate. The substrate was a 6-inch diameter aluminum disc. A composite coating containing 70% 56F-NS nickel was sprayed at approximately 9-12 lbs/h. At about 0.100-inch thickness, the coating began to debond from the substrate. When the coating was approximately 0.280-0.290-inch, it had developed a bow due to partial adherence to the substrate. Spraying continued, using batches containing some of the coarse Ni powder blended into the composite. At 0.370-0.380-inch thickness, a delamination was noted within the coating. The delamination started at the top of the sample and extended to approximately the mid-line such that about half of the coating had delaminated and half was intact. Spraying continued until the thickness in the non-delaminated was approximately 0.490-inch. Periodic reactivity testing produced fast, hot reactions that propagated to completion. These results indicate that some combination of coarse and fine Ni powders will produce the desired reaction.

Sample 1-15 was a copper tube substrate, 3-inches diameter×18-inches length. A 70% Ni (fine powder) composite was applied to this tube using the same method as used for 1-1 (aluminum tube substrate). The amount of sprayed powder was monitored to determine deposit efficiency. Two powder feeders were utilized, each spraying approximately 12-14 lbs/h. The coating was applied in 10-cycle increments, with cooling periods in between. Except for occasional stoppages to clean clogged powder ports, the application went smoothly. After 37 cycles the coating thickness was 0.200-0.210-inch. At this point, some of the coarse nickel powder was added to the composite blends. After 67 cycles, coating thickness had reached 0.320-inch. Some time during the next 15 cycles, a large crack formed through the length of the coating and application was halted. Total coating thickness was approximately 0.390-inch. Apparently, the substrate material has an effect on the quantity of coating that can be applied. A thickness in excess of 0.500-inch was possible with the aluminum tube substrate. It is possible that differences in coefficient of thermal expansion are responsible for the different substrate performances.

Measurements showed that a total of 9,947 g of powder were sprayed and that 4,944 g adhered as coating. This results in a deposition efficiency of 49.7%.

Example 7

The next coating trial combined coating of a tube substrate with production of a spherical sample. An aluminum tube substrate, 3-inches O.D.×12-inches length was prepared and fixtured similar to sample 1-1. A substrate for the spherical samples was fabricated by creating a hemispherical depression in an aluminum bar. This "cup" diameter was 1-inch and extended approximately 0.750-inch deep from surface to bottom. A threaded rod was inserted from the bottom to both mount the substrate and to force it out of the cup after coating. Since build up for a spherical sample would take considerable time and material, the sample was mounted near the end of the tube substrate. During the tube coating cycle the plasma gun travels to the end of the sample, stops momentarily, then returns. Placing the spherical substrate at the end of the gun travel would allow rapid coating build due to the stationary position of the spray gun with the benefit of using powder that would otherwise be wasted.

A composite blend of 70% nickel (coarse and fine powders)/30% aluminum was used. Standoff was about 5-inches for the tube sample and 7.5-inches for the spherical. Two air blast coolers were directed on the tube and one on the cup. Dual powder feeders were utilized, each spraying approximately 11-15 lbs/h. After 15 cycles, the tube coating had built to about 0.073-inch. An accurate measurement of the spherical structure could not be made. Coating had started to build up around the rim of the cup substrate, causing shadowing of the surface below. This buildup was removed before continuing the spray operations. After 15 more cycles the tube coating was about 0.138-inch. A section of overspray was subjected to ignition testing. The sample reacted readily but only propagated partially before stopping. This phenomenon is believed to be the result of the thin section used for testing. 40 additional coating cycles were run. The resulting tube coating (sample 2-1) was approximately 0.293-inch. The spherical slug was pushed out of the cup substrate with the threaded rod. This sample (2-1h) exhibited a smooth, regular surface where it was in contact with the substrate. However, considerable coating had been applied above the mold line and this material was irregularly shaped. It is believed that the sample is large enough to allow machining of a sphere, approximately 1-inch in diameter.

Sample 2-2 was a rectangular, steel plate about 4-inches×6-inches×0.135-inch. This article was coated with alternating layers of Ni and Al, using a single plasma gun and two powder feeders. Aluminum powder (Metco 54-NS) was placed in one feeder and nickel powder (Metco 56C-NS, 56F-NS) in the other. Although a blend of coarse and fine nickel powders was used, the coarse material comprised the bulk of the mixture. The spray window for the gun manipulator was set slightly larger than the substrate. During spray operations, the gun would move horizontally across the window, drop 0.25-inch and return to the other side. One spray cycle comprised coating from top to bottom, with the gun returning to the start point. One powder feeder would be operated during a spray cycle and when the cycle was complete, this feeder would be shut down and the other turned on. In this manner, alternating layers of Ni and Al were applied. Initially, the Ni feed rate was set at 15 lbs/h and the Al at 7.2-7.5 lbs/h. After 30 cycles, the coating had built to approximately 0.080-inch. At this point, the coating was removed and underwent reactivity testing. The material reacted and started to propagate but soon stopped. If the torch were held on the sample continuously, the reaction would continue to completion.

Sample 2-3 was also a rectangular sample, coated with alternating Ni and Al layers. It was believed that the composition of 2-2 was Al-rich, resulting in slow, non-propagating reactivity. 2-3 was coated in a manner similar to 2-2 except that a revised coating schedule was utilized to obtain a coating with higher Ni-content. The coating was applied in 10-cycle increments, but instead of alternating Ni and Al layers the following pattern was used:

TABLE 1

| Cycle No. | Material sprayed |
|---|---|
| 1 | Ni |
| 2 | Al |
| 3 | Ni |
| 4 | Ni |
| 5 | Al |
| 6 | Ni |
| 7 | Al |
| 8 | Ni |
| 9 | Ni |
| 10 | Al |

After 30 cycles the coating thickness was approximately 0.070-0.080-inch. Sections of the coating were removed for reactivity testing. When heated, the samples ignited readily creating a high temperature reaction. However, the reactions did not propagate to completion unless the tourch was held on the sample for the duration. It was believed that the Al-content was still too high as evidenced by one sample that overhung the brick base used for testing. When ignited, this sample reacted then stopped. However, the portion that extended over the base softened and slumped 90° to conform to the vertical wall of the base. These results had not been seen with material that reacted to completion and was assumed to have a high Ni content.

Alternating Ni and Al layers were used to coat an aluminum tube substrate for sample 2-4. The substrate tube was 3-inches O.D.×12-inches length with a 0.065-inch wall. Substrate preparation and coating procedures were the same as used with the previously coated tubes. The Ni powder feed rate was set at approximately 16-20 lbs/h and the Al at 4-5 lbs/h. Again, 10-cycle increments were employed in conjunction with the Ni-rich coating schedule used for sample 2-3. A total of 120 cycles was used to apply a coating of approximately 0.262-inch. The coating appeared defect free with good adherence to the substrate. A witness plate was installed at the end of the tube and a section of coating (0.485-0.490-inch thick) from this plate was used for reactivity testing. The material ignited and propagated very slowly to completion. Temperature of the reaction, as indicated by color, seemed to be less than typical.

Example 8

The next coating experiment was an effort to create 2 spherical samples simultaneously. Two of the hemispherical cup molds were clamped to a rack, separated by approximately 6-inches. The spray gun and manipulator were set up to traverse horizontally and the substrates were positioned in the center of the spray pattern. As with the cylindrical samples, one cycle comprised traversing to the end of the spray window and return to the starting point. Traverse speed was 20 inches/second. A composite blend of 80% Ni (coarse and fine powders)/20 Al spraying at about 16 lbs/h was used. An air blast cooler was directed at each sample.

The coating was applied in 5-cycle increments with periodic rotation of the molds to prevent preferential buildup. The coating built in a manner similar to that of sample 2-1h with material conforming to the inside of the cup but irregular growth outside of the mold confines. After 120 cycles, a reactivity test was performed on a section of overspray. The result was a fast, hot reaction that stopped before completion but propagated fully with some additional heat input. As spray operations progressed it was noted that the sample at the end of the outbound traverse was growing faster due to the manipulator pausing at this point before return. Therefore, the sample positions were occasionally switched to minimize this effect. Following 270 more cycles (390 total), one mold was removed. This coating slug, sample 2-5h, was easily removed from the mold.

An additional 100 cycles were added to the remaining sample. This slug, sample 2-5j, also released from the mold without difficulty.

Sample 2-7 was an effort to facilitate more rapid buildup for the spherical samples. The mold was inserted into the rotating chuck, the spray gun aligned along the axis of rotation and the spray pattern centered on the mold. Standoff distance was fixed at about 5-inches and air blast coolers were directed on the sample. Spraying was conducted in 30 s intervals. The coating built rapidly and consistently. After the first 30 s increment, the gun angle was adjusted to about 5° off-axis to prevent mounding in the center of the structure. Spraying continued for another 70 s total before adjusting the gun to approximately 15° from normal to allow sufficient build on the sides of the mold. A total of 400 s of spray time was required to complete the sample. Coating distribution was faster and more consistent than the traversing gun method, necessitating only minor, periodic adjustments to gun angle as high or low spots became evident. Sections of overspray were subjected to reactivity testing. These samples would ignite and partially propagate. If a small, additional heat input was supplied to the non-reacted area ahead of the flame front, the reactions would rapidly go to completion.

Example 9

Wire/Powder Combustion, Cylindrical Coatings or Structures

Several samples were made using a combination of wire and powder combustion spray. Sample TSPW-10 comprised a wood dowel, approximately 1.125-inches diameter by 4-inches long. The dowel was inserted into a rotating chuck and an air blast was used to cool the sample during spray operations. A Eutectic Teradyn 2000 combustion gun (acetylene/oxygen fueled) was used to spray −325 mesh, spherical Ni powder. A Metco 12E gun (acetylene/oxygen fueled) was used to spray Al wire. Two operators, each hand-spraying one of the materials, applied alternating layers of Ni and Al. While spraying, small flames would appear intermittently (assumed to be wood or volatiles burning) but could be extinguished with the application of more coating. The coating had a dark but uniform appearance with a thickness of about 0.025-inch.

Sample TSPW-15 comprised an empty, steel aerosol can (approximately 2.60-inches diameter×8-inches length) modified for use as a coating substrate. An extension rod was affixed to one end of the can and venting holes drilled in the other. The substrate was abrasive-blasted and rotated by inserting the extension arm into a spinning chuck. During spray operations, an air blast was used to cool the substrate. The same equipment and techniques used for TSPW-10 were used for this sample. After building the coating thickness to approximately 0.150-inch, the Ni powder was depleted. Additional coating was applied using aluminum powder (−100, +325 mesh) and Monel wire (70 Cu-30 Ni). The final coating thickness was 0.275-inch. The substrate was removed and the resulting cylindrical structure machined and polished to a final wall thickness of about 0.250-inch.

Sample TSPW-17 comprised a steel pipe substrate, approximately 1.880-inches diameter. As with TSPW-15, the substrate was abrasive blasted then rotated and cooled during coating. Alternating layers of Ni powder and Al wire were sprayed with periodic stoppages for cooling. The final coating thickness was about 0.550-inch. When a section of this structure was subjected to ignition testing, it failed to react. Chemical analysis indicated the composition was approximately 76 Al-18 Ni. Apparently a composition this Al-rich is not favorable to nickel aluminide formation. These results illustrate the difficulties of obtaining the preferred stoichiometry when using manual application, especially when the deposition rate of one process (combustion wire spray) is much higher than the other (combustion powder). DSC of TSPW-17 showed a low energy output density. However, there were two small exotherms. One occurred at about 620° C., just prior to aluminum melting, and one at about 650° C., just after melting. The total heat output was approximately evenly divided between these two exotherms. It is not clear why DSC indicated a reaction that was not evident with the flame ignition test. It should be noted that the pattern of gradual diffusion over time, seen with the plasma sprayed samples, is not present with TSPW-17.

Sample TSPW-18 utilized simultaneous spraying (co-spray) of Ni powder and Al wire. The substrate was a steel pipe, 1.880-inches outside diameter (O.D.). As with the previous samples, the substrate was abrasive blasted then rotated and cooled during coating. The coating materials were applied manually with an emphasis on reducing the amount of aluminum deposition. The final coating thickness was approximately 0.070-0.090-inch. A portion of the coating was removed for reactivity testing. The first attempt resulted in a moderate reaction that propagated partially through the sample before stopping. Ignition attempts at two other points eventually resulted in complete reaction. Chemical analysis of TSPW-18 shows a composition of about 55 Ni-40 Al. This is closer to the target composition of 68 Ni-32 Al than TSPW-17 (accounting for the increased reactivity of TSPW-18) but still Al-rich. It is thought that excess Al in the material depresses the exotherm temperature and rate since more heat energy must be used to melt the Al before liquid-phase aluminide formation can occur. If this "heat-sink" effect is large enough, the reaction will not start or will only propagate partially due to insufficient temperature. DSC analysis of TSPW-18 is similar to TSPW-17 in that there appears to be very little solid-state diffusion. There is a small amount starting at approximately 550° C. followed by a strong, exothermic spike that accompanies aluminum melting. Total energy output density is about 50% higher than TSPW-17.

Sample TSPW-19 comprised a thick coating layer on a cylindrical substrate. The substrate was a steel tube, 3.5-inches O.D.×3.5-inches length. The tube was prepared for coating by abrasive blasting then attaching end caps that were held in place by a threaded rod running through the bore. The axial rod was inserted into a rotating chuck and the assembly cooled with air blast during coating. Alternating layers of Ni wire and Al powder were sprayed. Coating deposits of about 0.050-0.060-inch were built up between stoppages for cooling. The approximate coating composition was verified by spraying small witness samples during each coating cycle and igniting them. Fast, hot reactions confirmed that the operators' estimate of deposition rates were on target. At about 0.225-inch coating thickness, a small crack was noted in the deposit. The crack grew with subsequent material application, eventually extending through the length of the sample. Deposition was halted at approximately 0.300-inch thickness. The crack was repaired by grinding the adjacent coating out to form a V-shaped notch. This area was filled with Al wire spray. The repair coating was built up beyond the original surface then ground back to this level. Following substrate removal and machining, it could be seen that the repair did not extend completely to the I.D. of the resulting tube. However, the repair is 90-95% complete. Chemical analysis of TSPW-19 shows a composition of about 73 Ni-24 Al. This slightly Ni-rich composition resulted in fast, complete reactions upon ignition testing. The DSC curve reveals that almost all of the exothermic energy was released after the aluminum went molten. Energy output density is slightly lower than TSPW-18.

Sample TSPW-21 was fabricated with the idea that excessive thermal cycling was responsible for the cracking that developed with TSPW-19. For TSPW-21, the same substrate configuration as TSPW-19 was used but the thermal spray time was limited to two minutes before stopping to cool. During these two-minute cycles, alternating Ni powder and Al wire layers were applied. Results are shown below.

TABLE 2

| Cycle No. | Coating Thickness (in) |
|---|---|
| 1 | 0.025 |
| 2 | 0.040 |
| 3 | 0.050 |
| 4 | 0.065 |
| 5 | 0.080 |
| 6 | 0.095 |
| 7 | 0.115 |
| 8 | 0.130 |
| 9 | 0.145 |

After cycle #9, the coating cracked in two places during cool down. One more sray cycle was used to fill the cracks, increasing the coating thickness to about 0.150-inch. However, the cracks reformed during cooling.

TSPW-22 was another cylindrical coating, applied in the same manner as TSPW-19 and 21. Alternating Ni powder and Al wire coatings were applied to the rotating substrate. After each cycle, the sample was allowed to cool below 100° F. before resuming spray operations. Results are shown below.

TABLE 3

| Cycle No. | Coating Thickness (in) |
|---|---|
| 2 | 0.075–0.80 |
| 3 | 0.100 |
| 4 | 0.130 |

TABLE 3-continued

| Cycle No. | Coating Thickness (in) |
|---|---|
| 5 | 0.160 |
| 6 | 0.180 |

A small crack was detected during cooling after cycle number five and subsequently grew through the length of the sample. A repair was made by opening the crack, via grinding, to form a V-shaped notch. Aluminum wire was sprayed into this area, rapidly filling the void above the original coating level. The repaired area was ground to reduce its thickness and blend it into the adjacent coating. After grinding, the repair protruded about 0.030-inch above the coating O.D. Additional Ni and Al spray coats were then applied as shown below.

TABLE 4

| Cycle No. | Coating Thickness (in) |
|---|---|
| 7 | 0.210 |
| 8 | 0.235 |
| 9 | 0.290 |

No further cracking resulted from the additional coating. The repaired area protruded slightly above the main body of the cylinder but subsequent machining and polishing removed this protrusion and the repair could not be visually detected on the O.D. Some voids were noted at the repair I.D. but no separation between repair and surrounding coating was evident.

Reactivity testing on a section of TSPW-22 revealed that ignition at one end of the sample initiated a reaction of moderate speed that propagated to the point of the Al-filled repair, where it stopped. Initiation from the opposite end of the sample produced the same result except that the propagation front paused briefly at the repair then continued through this region before stopping at the terminus of the previous reaction. It is believed that the first reaction was quenched by the excess aluminum of the repair. However, a significant amount of heat was absorbed by the aluminum. When the reaction from the opposite end reached the repair, there was a delay until the aluminum absorbed enough additional heat to go molten. At this point, rapid intermetallic formation could occur and the reaction proceeded through the repair zone.

Chemical analysis of TSPW-22 shows an Al-rich composition of approximately 47 Al-44 Ni. It appears that excess Al content has a moderating effect on reaction and propagation of the combustion thermal spray samples. The table below summarizes reactivity testing of these samples.

TABLE 5

| Sample | Ni Content (%) | Al Content (%) | Reactivity |
|---|---|---|---|
| TSPW-17 | 18 | 76 | No reaction |
| TSPW-22 | 44 | 47 | Slow reaction, moderate heat |
| TSPW-18 | 55 | 40 | Moderate reaction, multiple attempts to complete |
| TSPW-19 | 73 | 24 | Fast, hot reaction |

DSC analysis of TSPW-22 showed that this composition had the highest energy output density of the combustion thermal spray (CTS) samples, with all of the output coming after the aluminum melting point (no solid state diffusion). This illustrates the major difference between the combustion spray and APS techniques. While the APS samples had a higher energy density, a majority of this output was released slowly via diffusion. By contrast, the CTS samples exhibited little or no diffusion in the solid state, but fast, intermetallic formation upon the onset of aluminum melting.

It is thought that adsorbed oxygen is playing some role in the reactivity of the thermal sprayed materials. X-ray diffraction (XRD) analysis was performed on the APS, VPS and CTS as-sprayed samples. The APS (APS-329) and VPS (VPS-335) patterns were similar, showing only the presence of elemental Ni and Al. However, the CTS sample (TSPW-22) contained NiO as well as Ni and Al. The NiO is probably contributing to the net energy output via a thermite-type reaction (e.g., $NiO+Al \rightarrow Ni+Al_2O_3$). This reaction occurs only after the aluminum has melted and enhances or even initiates the intermetallic reactions. Although CTS and plasma spray are both thermal spray processes, the Ni powder particles sprayed via CTS are moving at slower velocities than plasma spray and do not benefit from the argon plasma shielding. The longer residence times and oxy-fuel environment are more conducive to oxide formation. Since no oxides of aluminum were detected, it seems that atomization of the Al wire is a "cleaner" process than the powder spray.

Another possible explanation for the discrepancy in reactivity between plasma and combustion spray may be that the plasma spray technique utilized pre-blended, composite powder or a carefully metered co-spray mixture. In this manner, particle distribution and stoichiometry can be controlled. By contrast, combustion thermal spray coatings were applied by hand and, since no process feedback was possible, operators had to estimate application rates and thickness. It is assumed that plasma spray, with its orderly distribution of material, i.e., Al and Ni particles in close proximnity to each other and in the correct ratio, will be more susceptible to solid state diffusion than the less uniformly dispersed combustion spray.

Example 10

Wire/Powder Combustion, Plates

A combination of wire and powder combustion spray was used to produce several flat, plate samples. For these trials, a Eutectic Teradyn 2000 combustion gun (acetylene/oxygen fueled) was used to spray −325 mesh, spherical Ni powder. A Metco 12E gun (acetylene/oxygen fueled) was used to spray Al wire. Two operators, each hand-spraying one of the materials, applied alternating layers of Ni and Al. Sample TSPW-1 comprised an aluminum block with a machine-finished surface. Al wire was first sprayed on this surface but there was no adhesion and the coating debonded from the substrate in small flakes. The residual Al coating was removed and a thin layer of Ni powder was applied. The coating was non-uniform but bonded to the surface. An aluminum layer was then applied and it adhered to the Ni coating. Ni and Al coatings were applied in alternating fashion and built to a thickness of approximately 0.050-inch. The surface of the coating had a rough appearance and the coating structure was easily removed from the substrate. A section of this material underwent reactivity testing and a fast, hot reaction was observed.

TSPW-2 was a copper plate covered with Al foil (4 plies). It was believed that the foil would assist release from the substrate. The Ni powder was sprayed first but did not adhere. Al wire was then applied and a thin layer was bonded to the Cu substrate. Alternating layers of materials were added, building to a coating thickness of 0.080-0.090-inch. The coating structure exhibited some warpage and was easily removed from the substrate. Reactivity testing was similar to TSPW-1, i.e., fast, hot reaction.

TSPW-3 was an attempt to fabricate a thicker plate. The substrate was an aluminum plate, 2-inches×3-inches, covered with Al foil. Alternate layers of Ni and Al were applied, with coating application halted periodically to allow the sample to cool. After building to a thickness of approximately 0.165-inch and cooling, additional material was applied for a period of about 3-4 minutes. At this point, the coating reacted rapidly, creating a high temperature exotherm (white heat). There was no warning or visual indication of the impending reaction. The coating structure maintained its basic shape throughout the reaction, forming a hard, dense plate approximately 0.270-0.280-inch thick.

TSPW-6 examined the effect of co-spraying a blend of Ni and Al powders with the Teradyn combustion gun. A composition comprising 50 Ni-50 Al (atomic %) was used. The substrate was a Cu plate covered with Al foil. When first sprayed, the powder seemed to react with the Al foil (bright, glowing spots) but this ceased as additional coats were applied. The coating is much darker than the alternating Ni and Al coatings and was easily removed from the substrate. When subjected to reactivity testing, the material would glow orange wherever the torch impinged, but sustained propagation could not be effected. It is believed that either excessive oxidation or conversion to aluminides had occurred in the combustion flame.

Example 11

Twin Wire Arc Spray Coatings/Structures

Some experiments were conducted using wire arc spray to apply Ni+Al layered and composite coatings. Substrates were grit-blasted steel plates, 2.5"×4"×0.5". Sample PLS-1 was sprayed with alternating layers of Al and Ni wire. Although wire arc spray allows a rapid deposition rate, this trial proved to be a slow process due to the fact that only one machine was available. This required removing the wire spools after each coating layer and replacing them with the alternate material. In addition, it was difficult to determine the amount of each material that was being applied and if the target 1:1 atomic ratio was being achieved. Thickness measurements were made after each coating layer but without knowing the density or actual deposition rate, the operators could only make rough estimates of the applied mass. The coating was built to approximately 0.100-inch thickness and appeared to have a good bond to the substrate. A section was removed for reactivity testing. Despite repeated attempts and extensive heating, no reaction or propagation was evident. Chemical analysis of the coating shows about 90 Ni-12 Al. This indicates that Ni-rich compositions are as non-reactive as those that are Al-rich.

Sample PCS-1 was an attempt to spray a Ni/Al composite by using one spool of Ni wire and one spool of Al wire to create the arc. Both spools fed at the same rate so no attempts at customizing the composition ratio could be made. The material sprayed well and was built to a thickness of about 0.125-inch. Some debonding was evident but a second sample was sprayed in a similar manner and the coating-to-substrate bond remained intact. The PCS-1 coating layer was removed and checked for reactivity. When first heated, the sample began to glow as if a reaction was starting but no propagation was evident and the sample cooled when the heat source was removed. The second attempt (at a different location) resulted in ignition and slow propagation to completion. Temperature during propagation appeared lower than the more energetic, faster reactions. Chemical analysis of PCS-1 shows a composition of about 85 Ni-16 Al. Although not the target 1:1 atomic ratio (68 Ni-32 Al), the PCS-1 composition was closer than PLS-1 and appears to be at the outer limit for reactivity. This indicates that, with some modification of the wire compositions, wire arc spray can be used to produce materials of greater reactivity.

Example 12

Aluminum Welding with Ni/Al Composite Filler

An attempt was made to weld two sheets of aluminum using an aluminum-nickel composite as the filler material. The composite was heated until a high-temperature, exothermic reaction occurred, creating the heat required for fusion.

Two pieces of aluminum alloy 6061 were used as the top and bottom sheets. Each piece measured approximately 1"×1"×0.125". The filler was a section of an air plasma sprayed composite APS-337 produced as in Example 4. The APS-337 composite was originally produced as a co-sprayed (Ni and Al powders fed from separate hoppers) tube with an approximate wall thickness of 0.280". A section was removed from the tube and machined on both sides to produce a coupon approximately 1.1"×1"×0.250". This coupon was inserted between the aluminum sheets and the assembly held together with a C-clamp. Refractory insulating sheets were placed between the clamp and the Al sheets to prevent thermal loss during heating and reaction.

A propane torch flame was directed on the filler section and held for about 60 seconds without the Ni+Al reaction occurring. It was believed that the heat input was insufficient to overcome the heat capacity of the assembly and get the composite up to reaction temperature. An oxy-acetylene torch was then used to heat the composite. After only 2-4 seconds of heating, the composite ignited and reacted rapidly, bringing the entire package to a high temperature (red heat). Some evidence of aluminum melting, presumed to be one of the Al sheets, was seen at one end of the sample. After cooling, it was seen that both Al sheets had developed a bond to the filler, although some gaps between filler and sheet were seen at the sample edges.

The present invention provides for the formation of reactive multi-layer structures via thermal spray processes, including plasma spray, vacuum plasma spray, ambient wire spray forming techniques and the like. By pulsing each reactive material, layers of varying thicknesses can be formed, yet very high-density structures can be formed. The approach allows mechanical strengths of conventional plasma spray metal systems. By the optional use of vacuum plasma spray, the structure can control the buildup of oxide layers that could inhibit the thermal energy of the reaction.

This approach offers a major advantage over vapor deposition or condensation techniques. Plasma spray forming can be rapid and can form large structures. The ability exists to form thick structures, e.g., as thick as one-half inch by 12 inches in as little as an hour. The process can be controlled by multi-axis tools, including robotics. The process can be applied onto existing structures, or even on composite lay-ups for additional structural benefits.

Whereas particular embodiments of this invention have been described above for purposes of illustration, it will be evident to those skilled in the art that numerous variations of the details of the present invention may be made without departing from the invention.

What is claimed is:

1. A method of making a reactive material, the method comprising thermally spraying reactive components of the reactive material onto a substrate to build up a green body comprising the reactive components, wherein the reactive components are heated during the thermal spraying to a temperature below which they reach a fully molten state, and wherein at least a portion of the reactive components present in the green body after the thermal spraying step are exothermically reactive with each other upon subsequent heating of the reactive material to produce a heat of reaction of at least 1,000° C.

2. The method of claim 1, wherein the thermal spray process comprises flame spraying, plasma arc spraying, electric arc spraying, high velocity oxy-fuel deposition, cold spraying, detonation gun deposition or super detonation gun deposition.

3. The method of claim 1, wherein the reactive components are thermally sprayed onto the substrate at the same time.

4. The method of claim 3, wherein the reactive components are thermally sprayed onto the substrate from different thermal spray guns.

5. The method of claim 3, wherein the reactive components are thermally sprayed onto the substrate from a single thermal spray gun.

6. The method of claim 1, wherein the reactive components are thermally sprayed onto the substrate sequentially.

7. The method of claim 6, wherein the reactive components are sprayed onto the substrate from different thermal spray guns.

8. The method of claim 1, further comprising removing the reactive material from the substrate.

9. The method of claim 1, wherein the substrate is rotated during the thermal spraying.

10. The method of claim 1, wherein the substrate is cooled during the thermal spraying.

11. The method of claim 10, wherein the cooling is achieved by a cooling fluid.

12. The method of claim 11, wherein the cooling fluid is directed against a surface of the substrate upon which the reactive components are thermally sprayed.

13. The method of claim 11, wherein the cooling fluid is directed against a back surface of the substrate opposite from a surface of the substrate upon which the reactive components are thermally sprayed.

14. The method of claim 11, wherein the cooling fluid comprises a gas.

15. The method of claim 1, wherein one of the reactive components comprises at least one element selected from Ni, Ti, Nb, V, Ta, W, Hf, U and Si, and another one of the reactive components comprises at least one element selected from Al, Mg, Ni, C and B.

16. The method of claim 1, wherein one of the reactive components comprises at least one metal oxide selected from $Fe_xO_y$, $Ni_xO_y$, $Ta_xO_y$, $TiO_2$, $CuO_x$, $WO_x$, $Al_2O_3$, and another one of the reactive components comprises at least one material selected from Al, Mg, Ni and $B_4C$.

17. The method of claim 1, wherein one of the reactive components comprises Ni and another one of the components comprises Al.

18. The method of claim 1, wherein the reactive components comprise different metals provided in selected amounts to form an intermetallic comprising the metals upon exothermic reaction of the reactive metal components.

19. The method of claim 18, wherein the intermetallic comprises nickel aluminide and/or titanium aluminide.

20. The method of claim 1, wherein the thermally sprayed reactive components are deposited on the substrate at a rate of at least 0.01 mm per hour.

21. The method of claim 1, wherein the thermally sprayed reactive components are deposited on the substrate at a rate of at least 0.1 mm per hour.

22. The method of claim 1, wherein the thermally sprayed reactive components are deposited on the substrate at a rate of at least 1 mm per hour.

23. The method of claim 18, wherein the reactive components are intermixed within the reactive material.

24. The method of claim 1, wherein the reactive components comprise different layers in the reactive material.

25. The method of claim 24, wherein each of the layers has a thickness of from about 1 micron to about 5 mm.

26. The method of claim 24, wherein the layers of reactive components are directly adjacent each other.

27. The method of claim 24, wherein the layers of reactive components are separated from each other.

28. The method of claim 27, wherein the layers of reactive components are separated by at least one layer of inert material.

29. The method of claim 28, wherein the inert material comprises $Al_2O_3$ and/or SiO.

30. The method of claim 1, wherein the reactive material has a porosity of less than about 10 volume percent.

31. The method of claim 1, wherein the reactive material has a porosity of less than about 5 volume percent.

32. The method of claim 1, wherein the reactive material has a porosity of less than about 2 volume percent.

* * * * *